United States Patent [19]

Byszewski et al.

[11] Patent Number: 4,521,718

[45] Date of Patent: Jun. 4, 1985

[54] BEAM MODE LAMP WITH VOLTAGE MODIFYING ELECTRODE

[75] Inventors: Wojciech W. Byszewski, Arlington; A. Bowman Budinger, Westford; Joseph M. Proud, Wellesley Hills, all of Mass.

[73] Assignee: GTE Laboratories Incorporated, Waltham, Mass.

[21] Appl. No.: 462,736

[22] Filed: Feb. 1, 1983

[51] Int. Cl.[3] ..... H05B 39/00

[52] U.S. Cl. ..... 315/99; 315/361; 315/268; 315/349; 315/351

[58] Field of Search ..... 315/260, 268, 270, 349, 315/350, 99; 313/193, 194, 199, 200

[56] References Cited

U.S. PATENT DOCUMENTS

| | | | |
|---|---|---|---|
| 1,617,179 | 2/1927 | Smith | 313/205 |
| 1,768,660 | 7/1930 | Brackett | 315/99 |
| 1,901,128 | 3/1933 | Smith | 315/326 |
| 1,946,336 | 2/1934 | Smith | 313/105 |
| 2,235,711 | 3/1941 | Ledever | 315/99 |
| 2,264,055 | 11/1941 | Stocker | 315/99 |
| 2,345,638 | 4/1944 | Sperti | 315/99 |
| 2,424,505 | 7/1947 | Rupersburg | 315/99 |
| 2,736,842 | 2/1956 | Mann | 315/335 |
| 3,295,013 | 12/1966 | Struven | 313/598 |

*Primary Examiner*—Harold Dixon

*Attorney, Agent, or Firm*—J. Stephen Yeo

[57] ABSTRACT

A beam mode lamp has two discharge electrodes which alternately function as anode and cathode. One or more modifying electrodes are located between the discharge electrodes. Each modifying electrode is kept equal to or negative with respect to the cathode, raising the operating voltage of the lamp from a normal 20 volts to line voltage.

6 Claims, 5 Drawing Figures

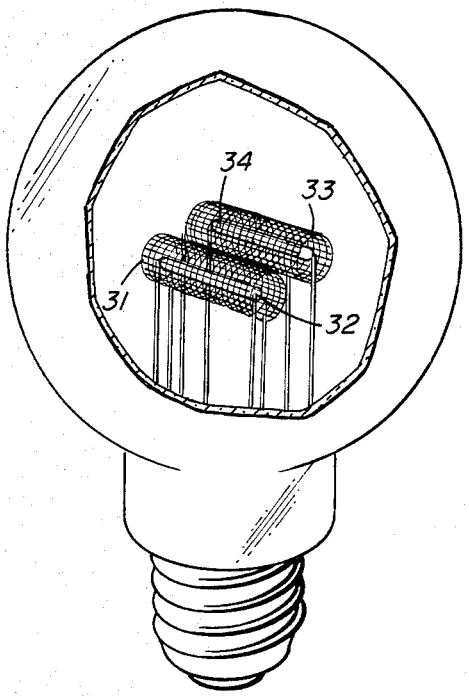
FIG. 3
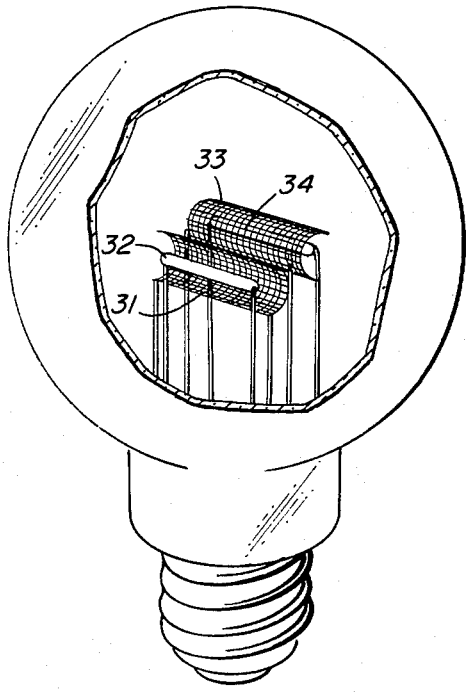
FIG. 4
FIG. 5
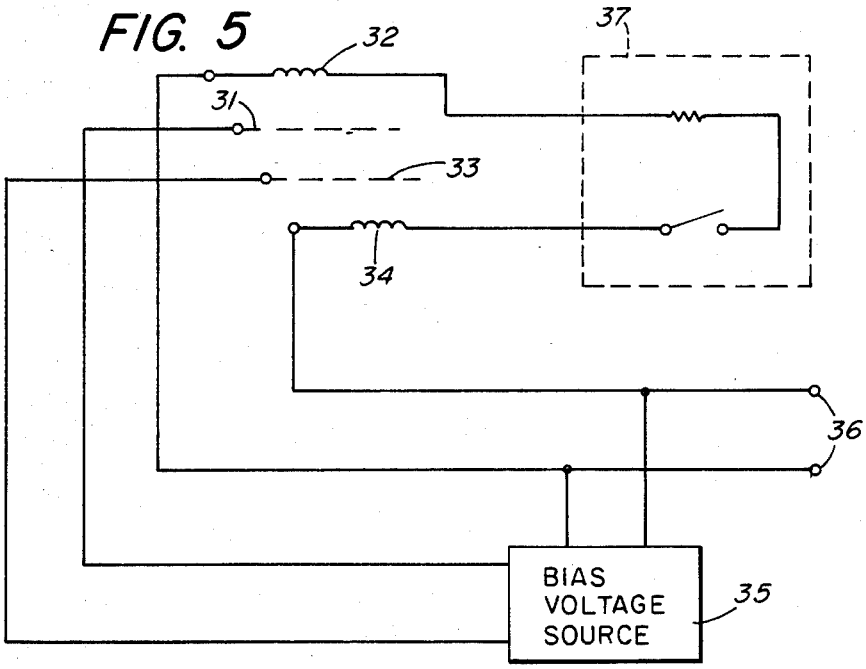

BEAM MODE LAMP WITH VOLTAGE MODIFYING ELECTRODE

CROSS REFERENCE TO RELATED APPLICATION

The present invention is related to U.S. patent application Ser. No. 337,046, filed Jan. 4, 1982, for "Dual Cathode Beam Mode Fluorescent Lamp" (D-23,849).

BACKGROUND OF THE INVENTION

This invention pertains to electric lamps and, more particularly, is concerned with electric lamps of the beam mode variety.

Beam mode lamps utilize anode and cathode discharge electrodes to form an electron beam. The discharge electrodes are arranged so that the electric beam extends beyond the anode into a drift region. The electrodes and drift region are within the volume of a transparent envelope. An excitable fill material permeates the volume and emits ultraviolet radiation when excited by the electron beam. The ultraviolet radiation can be converted to visible radiation by a phosphor coating upon the envelope.

When it was first conceived, the beam mode lamp was a DC device with an operating voltage of about 20 volts. In order for this lamp to be operated from common 120 AC line voltage, it is necessary to supply a step down transformer and a full wave rectifier.

An improved beam mode lamp described in co-pending application Ser. No. 337,046, filed Jan. 4, 1982, for "Dual Cathode Beam Mode Fluorescent Lamp" has two discharge electrodes which alternate their functions as cathode and anode. This arrangement allows the lamp to operate on AC voltage without a rectifier. A step down transformer or the like is still necessary, however. It is manifestly desirable to provide a dual cathode beam mode lamp which may be operated directly at line voltage without the need of a step down transformer.

SUMMARY OF THE INVENTION

In one aspect of the invention, a beam mode lamp has an envelope containing two discharge electrodes and at least one modifying electrode interposed between the discharge electrodes. The electrodes are immersed in a fill material which is excited by electrons. The two discharge electrodes are connected to the AC line voltage and function alternately as cathode and anode forming electron beams.

The modifying electrode is arranged to be biased at zero or negative electrical potential referred to that of the cathode sufficient to raise the operating voltage of the lamp to line voltage.

BRIEF DESCRIPTION OF THE DRAWINGS

In the drawings:

FIG. 3 shows a beam mode lamp having two modifying electrodes;

FIG. 4 depicts another embodiment of a beam mode lamp with two modifying electrodes; and FIG. 5 is a schematic representation of electrical components of the lamps of FIGS. 3 and 4.

For a better understanding of the present invention, together with other and further objects, advantages, and capabilities thereof, reference is made to the following disclosure and appended claims in connection with the above-described drawings.

DESCRIPTION OF THE INVENTION

Figure 1:
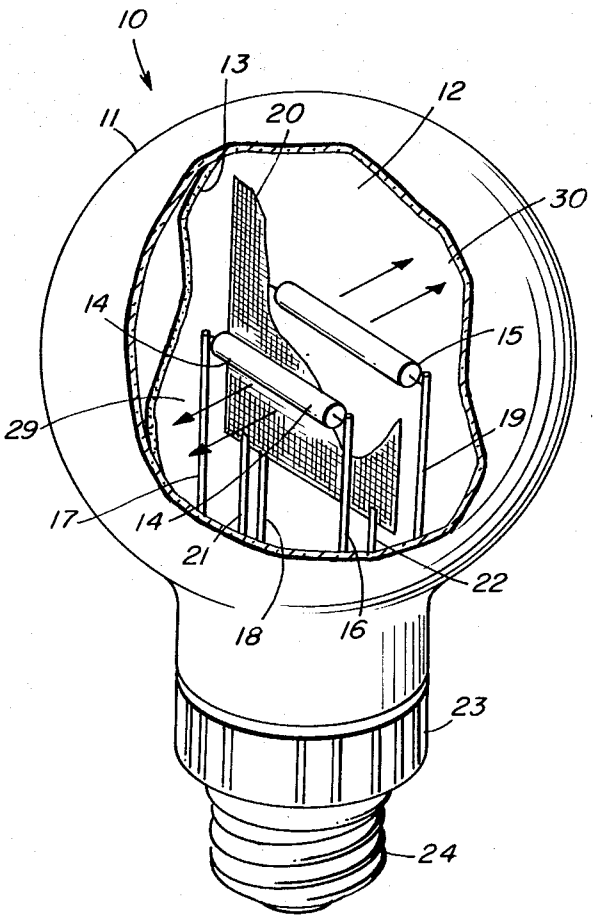
FIG. 1 illustrates a beam mode lamp having a single modifying electrode.

Referring to FIG. 1, there is seen a cutaway view of a beam mode fluorescent lamp 10 representing one embodiment of the present invention. A lamp envelope 11 made of a light transmitting substance (e.g., glass) encloses a discharge volume 12. The discharge volume is permeated with a fill material which emits ultraviolet radiation upon excitation. A typical fill material includes mercury and a noble gas (e.g., neon) or mixtures of noble gases. The inner surface of lamp envelope 11 is coated with a phosphor layer 13 which emits visible light upon absorption of ultraviolet radiation. Enclosed within the discharge volume of the envelope 11 are first and second discharge electrodes 14 and 15. Upon application of AC voltage, these discharge electrodes 14 and 15 function alternately as anode and cathode; at one particular time, one electrode is an anode and the other electrode is a cathode.

Discharge electrode 14 is connected between conductors 16 and 17, and discharge electrode 15 is connected between conductors 18 and 19. Each of the conductors has the same length so that the two discharge electrodes 14 and 15 are supported parallel about one centimeter apart in the same plane.

As a feature of the invention, at least one modifying electrode is interposed between first and second discharge electrodes.

Preferably the potential of the modifying electrode is kept equal to or negative with respect to that of the then cathodial discharge electrode. This increases the operating voltage of the lamp from what otherwise would be typically 20 volts to 120 volt line voltage, thereby eliminating the need for a step down transformer to supply reduced voltage to the discharge electrode.

The voltage of the modifying electrode is selected to cause the lamps operating voltage (that is to say, to voltage between the first and second discharge electrodes) to be compatible with line voltage. A peak modifying electrode bias voltage of from zero to about minus 20 volts referenced to cathode is typical.

In the specific embodiment illustrated by FIG. 1, a single modifying electrode 20 is positioned equidistant from both the first and second discharge electrodes 14 and 15. The modifying electrode 20, in this embodiment, is a flat mesh orthogonal to the plane of the first and second discharge electrodes 14, 15. A wire or other configuration may be used instead of a mesh. The modifying electrode 20 is supported by conductors 21 and 22.

Conductors 16, 17, 18, 19, 21 and 22 pass through a hermetic seal in envelope 11 to an enclosure 23 wherein electrical connections may be made to other electrical components. Conductors 18 and 17 couple one end of discharge electrodes 15 and 14, respectively, to AC line voltage terminals on base 24 which is adapted for insertion into a conventional incandescent lamp socket. Conductors 19 and 16 may connect the other ends of discharge electrodes 15 and 14, respectively, to a preheat starting circuit 25 located in enclosure 23.

Figure 2:
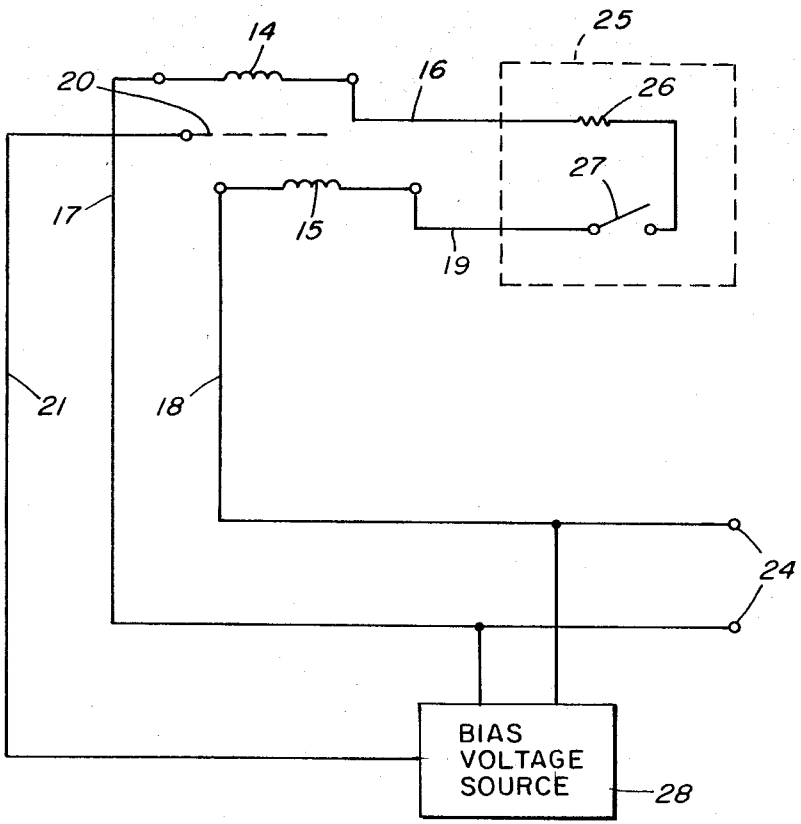
FIG. 2 is a schematic representation of electrical components of the lamp of FIG. 1.

The components within enclosure 23 are schematically shown in FIG. 2. The starting circuit 25 may include a resistor 26 and a normally closed thermally actuated switch 27. The modifying electrode is shown electrically connected to a bias voltage source 28 which may be energized by line voltage.

When the lamp is first turned on current flows in series through electrode 14, resistor 26, thermal switch 27, and electrode 15. Thermal switch 27 heats and opens whereupon AC line voltage is applied to discharge electrodes 14 and 15. During the first half cycle of the AC line voltage, discharge electrode 14 will be at a positive polarity with respect to electrode 15. As a result, discharge electrode 15 will function as a thermionic cathode to emit electrons, thereby forming an electron beam as shown in FIG. 1 by the arrows. Discharge electrode 14 will function as an anode and operate to accelerate the electron beam into a corresponding first drift region 29.

On the alternate half cycle of the AC line voltage, discharge electrode 15 will be positive with respect to discharge electrode 14. Then, discharge electrode 14 will function as a thermionic cathode to emit electrons forming a second electron beam as a result. Discharge electrode 15 will operate as an anode and accelerate the formed electron beam into a corresponding second drift region 30.

During each half cycle the modifying electrode is electrically zero or negatively biased to the then cathode. This arrangement limits current flow and raises the operating voltage of the lamp.

The two drift regions 29, 30 are located within envelope 11 and extend in the direction of electron beam flow indicated, during alternate half cycles of the AC line voltage. Electrons in each region collide with atoms of the fill material, thereby causing excitation of a portion of the fill material atoms and emission of ultraviolet radiation, and causing ionization of respective portions of the fill material atoms, thereby yielding secondary electrons. These secondary electrons cause further emissions of ultraviolet radiation.

Due to the alternating cathode-anode interchange of discharge electrodes 14 and 15, the electrons which are collected by the particular discharge electrode which is then functioning as an anode, will serve to heat this anode. However, the anode of the then half cycle is the cathode of the next half cycle so that the heat stimulates the emission of electrons during the next half cycle.

Other embodiments of the invention, such as the two embodiments seen in FIGS. 3 and 4, may use two modifying electrodes. In both embodiments, a first modifying electrode 31 is associated with a corresponding first discharge electrode 32 and a second modifying electrode 33 is associated with a corresponding second discharge electrode 34. The modifying electrodes are shown as cylindrically curved meshes but a wire or other configuration may be used. Each modifying electrode is connected to a bias voltage source so that it is zero or negatively biased with respect to its corresponding discharge electrode when it is functioning as a cathode. In FIG. 3, each modifying electrode forms a completed cylindrical structure and surrounds its corresponding discharge electrode. The embodiment seen in FIG. 3 is similar to that of FIG. 4 except the modifying electrodes 31, 33 are half cylindrical.

In both of these embodiments, a bias voltage source 35 keeps each modifying electrode 31, 33 zero or negatively biased with respect to its corresponding discharge electrode 32, 34 when that electrode is cathodial. The operation of these embodiments is otherwise the same as the first embodiment with one end of each discharge electrode 32, 34 connected to AC terminals 36 and the other ends in series with a start circuit 37.

Although three preferred embodiments of the invention have been illustrated and described, it will be readily apparent to those skilled in the art that various modifications may be made therein without departing from the spirit of the invention or from the scope of the appended claims.

We claim:

1. A beam mode discharge lamp of the type previously operating at approximately 20 volts comprising:
- an envelope substantially transparent to visible light and defining a volume;
- an electron excitable fill material permeating said volume;
- a first discharge electrode and a second discharge electrode arranged within said envelope;
- at least one modifying electrode, at least part of which is interposed between said first and second discharge electrodes;
- means for applying AC line voltage to said first and second discharge electrodes, said first and second discharge electrodes functioning alternately as cathode and anode and forming electron beams between the discharge electrodes and extending into drift regions beyond the discharge electrodes; and
- means for applying negative bias voltage with respect to the then cathode to said modifying electrode sufficient to allow the lamp to operate safely with line voltage between the first and second discharge electrodes.

2. The beam mode lamp of claim 1 having a single modifying electrode wherein said modifying electrode is a flat mesh positioned equidistant from both the first and second discharge electrodes.

3. The beam mode lamp of claim 1 wherein said modifying electrode is a single wire positioned equidistant from said first and second discharge electrodes.

4. A beam mode discharge lamp of the type previously operating at approximately 20 volts comprising:
- an envelope substantially transparent to visible light and defining a volume;
- an electron excitable fill material permeating said volume;
- a first discharge electrode and a second discharge electrode arranged within said envelope;
- a first modifying electrode corresponding to said first discharge electrode at least part of which is interposed between said first and second electrodes;
- a second modifying electrode corresponding to said second discharge electrode at least part of which is interposed between said first and second electrodes;
- means for applying AC line voltage to said first and second discharge electrodes, said first and second discharge electrodes functioning alternately as cathode and anode and forming electron beams between the discharge electrodes and extending into drift regions beyond the discharge electrodes; and
- means for applying negative bias voltage to said modifying electrodes with respect to the corresponding discharge electrode at a voltage sufficient to allow the lamp to operate safely with line voltage between the discharge electrodes.

5. The beam mode lamp of claim 4 wherein said modifying electrodes are screens forming at least part of a cylinder arranged about the corresponding discharge electrode.

6. The beam mode lamp of claim 1 wherein said modifying electrode is in the form of a conductive mesh kept at approximately the same potential as the cathode discharge electrode and said operating voltage is AC line voltage.

* * * * *